US008791817B2

(12) United States Patent
Sweeney et al.

(10) Patent No.: US 8,791,817 B2
(45) Date of Patent: Jul. 29, 2014

(54) SYSTEM AND METHOD FOR MONITORING A LOCATION

(75) Inventors: Jeffrey Sweeney, Overland Park, KS (US); Kelsyn D. S. Rooks, Overland Park, KS (US)

(73) Assignee: CenturyLink Intellectual Property LLC, Denver, CO (US)

( * ) Notice: Subject to any disclaimer, the term of this patent is extended or adjusted under 35 U.S.C. 154(b) by 115 days.

(21) Appl. No.: 12/256,359

(22) Filed: Oct. 22, 2008

(65) Prior Publication Data

US 2010/0097214 A1 Apr. 22, 2010

(51) Int. Cl.
*G08B 1/08* (2006.01)

(52) U.S. Cl.
USPC ..... 340/539.14; 340/539.21; 340/545.1

(58) Field of Classification Search
USPC ..... 455/435.1; 340/572.1, 506, 528
See application file for complete search history.

(56) References Cited

U.S. PATENT DOCUMENTS 4,598,275 A * 7/1986 Ross et al. ..... 340/573.4
4,814,751 A * 3/1989 Hawkins et al. ..... 340/573.1
5,301,353 A * 4/1994 Borras et al. ..... 455/9
6,057,764 A * 5/2000 Williams ..... 340/572.1
6,259,405 B1 7/2001 Stewart et al.
6,327,535 B1 12/2001 Evans et al.
6,331,817 B1 * 12/2001 Goldberg ..... 340/573.1
6,396,413 B2 * 5/2002 Hines et al. ..... 340/8.1
6,531,963 B1 * 3/2003 Nyfelt ..... 340/573.1
6,774,811 B2 * 8/2004 Kaufman et al. ..... 340/8.1
6,894,612 B2 * 5/2005 Xydis ..... 340/539.11
6,917,288 B2 * 7/2005 Kimmel et al. ..... 340/511
6,963,277 B2 * 11/2005 Imasaki et al. ..... 340/539.1
6,968,179 B1 11/2005 De Vries
7,102,509 B1 * 9/2006 Anders et al. ..... 340/539.13
7,120,135 B2 * 10/2006 Kim ..... 370/329
7,123,126 B2 * 10/2006 Tanaka et al. ..... 340/5.2
7,132,941 B2 * 11/2006 Sherlock ..... 340/539.26
7,138,920 B2 * 11/2006 Nyfelt ..... 340/573.1
7,142,122 B2 * 11/2006 Butikofer et al. ..... 340/573.1
7,149,297 B2 12/2006 Idoni et al.
7,167,094 B2 * 1/2007 Ciarcia et al. ..... 340/568.1
7,203,674 B2 4/2007 Cohen
7,218,930 B2 * 5/2007 Ko et al. ..... 455/426.1

(Continued)

OTHER PUBLICATIONS

U.S. Appl. No. 12/332,537; Final Rejection dated Nov. 9, 2011; 20 pages.

(Continued)

*Primary Examiner* — Jennifer Mehmood
*Assistant Examiner* — Rufus Point
(74) *Attorney, Agent, or Firm* — Swanson & Bratschun, L.L.C.

(57) ABSTRACT

According to one embodiment of the invention, a method for monitoring a location is presented. The method includes monitoring one or more entryways of a building to detect when an entryway of the building is being opened and responsive to detecting an entryway of the building being opened, the method monitors for a presence of one or more wireless devices within a range of a residential wireless access point located within the building. In response to detecting the presence a wireless device within the range of the residential wireless access point, the method identifies an identifier associated with the wireless device. The method determines whether the identifier associated with the wireless device is registered with the residential wireless access point and responsive to the identifier associated with the wireless device being unregistered with the residential wireless access point, the method performs a user-specified event.

18 Claims, 6 Drawing Sheets

(56) References Cited

U.S. PATENT DOCUMENTS

| | | | | |
|---|---|---|---|---|
| 7,275,689 | B2 | 10/2007 | Mak | |
| 7,286,158 | B1 * | 10/2007 | Griebenow | 348/156 |
| 7,286,837 | B2 | 10/2007 | Giniger et al. | |
| 7,319,386 | B2 * | 1/2008 | Collins et al. | 340/539.12 |
| 7,366,522 | B2 * | 4/2008 | Thomas | 455/456.1 |
| 7,382,895 | B2 * | 6/2008 | Bramblet et al. | 382/103 |
| 7,386,595 | B1 | 6/2008 | Bloomer et al. | |
| 7,426,197 | B2 * | 9/2008 | Schotten et al. | 370/328 |
| 7,433,648 | B2 * | 10/2008 | Bridgelall | 455/41.2 |
| 7,454,203 | B2 | 11/2008 | Levitan | |
| 7,460,020 | B2 * | 12/2008 | Reyes et al. | 340/573.1 |
| 7,495,551 | B2 * | 2/2009 | Waxman | 340/539.1 |
| 7,495,562 | B2 * | 2/2009 | Monroe | 340/572.1 |
| 7,504,940 | B2 * | 3/2009 | Luebke et al. | 340/539.26 |
| 7,505,607 | B2 * | 3/2009 | Meunier et al. | 382/103 |
| 7,508,310 | B1 | 3/2009 | Light et al. | |
| 7,515,043 | B2 * | 4/2009 | Welch et al. | 340/539.12 |
| 7,554,446 | B2 * | 6/2009 | Ciarcia et al. | 340/568.1 |
| 7,561,019 | B2 * | 7/2009 | Sasakura et al. | 340/5.1 |
| 7,592,909 | B2 * | 9/2009 | Zaruba et al. | 340/539.13 |
| 7,634,283 | B2 * | 12/2009 | Luebke | 455/500 |
| 7,671,728 | B2 * | 3/2010 | Buehler | 340/506 |
| 7,693,512 | B1 | 4/2010 | West | |
| 7,739,340 | B2 | 6/2010 | Arenburg et al. | |
| 7,751,829 | B2 * | 7/2010 | Masuoka et al. | 455/456.1 |
| 7,801,975 | B2 | 9/2010 | Styles | |
| 7,844,055 | B2 | 11/2010 | Mukherjee et al. | |
| 7,898,419 | B2 * | 3/2011 | Cristache | 340/572.1 |
| 7,907,955 | B2 | 3/2011 | Virk et al. | |
| 7,984,105 | B2 | 7/2011 | Griffin | |
| 8,040,219 | B2 * | 10/2011 | Haartsen et al. | 340/8.1 |
| 8,041,586 | B2 | 10/2011 | Jethani et al. | |
| 8,064,928 | B2 | 11/2011 | Venkatachalam | |
| 8,091,778 | B1 | 1/2012 | Block et al. | |
| 8,102,238 | B2 * | 1/2012 | Golander et al. | 340/5.2 |
| 8,331,931 | B2 * | 12/2012 | Whitesell et al. | 455/435.1 |
| 8,428,620 | B2 | 4/2013 | Sweeney et al. | |
| 8,655,693 | B2 | 2/2014 | Gupta | |
| 2001/0001239 | A1 * | 5/2001 | Stewart | 342/457 |
| 2001/0046215 | A1 * | 11/2001 | Kim | 370/329 |
| 2002/0077077 | A1 * | 6/2002 | Rezvani et al. | 455/410 |
| 2002/0091569 | A1 | 7/2002 | Kitaura et al. | |
| 2002/0104012 | A1 * | 8/2002 | Xydis | 713/200 |
| 2002/0156787 | A1 | 10/2002 | Jameson et al. | |
| 2002/0193973 | A1 | 12/2002 | Kinoshita et al. | |
| 2003/0197612 | A1 * | 10/2003 | Tanaka et al. | 340/572.1 |
| 2003/0210148 | A1 * | 11/2003 | Imasaki et al. | 340/573.1 |
| 2004/0198311 | A1 * | 10/2004 | Aerrabotu et al. | 455/404.1 |
| 2004/0225681 | A1 | 11/2004 | Chaney et al. | |
| 2004/0266421 | A1 * | 12/2004 | Kato et al. | 455/422.1 |
| 2005/0206518 | A1 * | 9/2005 | Welch et al. | 340/539.12 |
| 2005/0280535 | A1 * | 12/2005 | Gary, Jr. | 340/572.1 |
| 2006/0015376 | A1 | 1/2006 | Sattler et al. | |
| 2006/0015491 | A1 | 1/2006 | Lee et al. | |
| 2006/0031326 | A1 | 2/2006 | Ovenden | |
| 2006/0063540 | A1 * | 3/2006 | Beuck | 455/456.3 |
| 2006/0075038 | A1 | 4/2006 | Mason et al. | |
| 2006/0105751 | A1 * | 5/2006 | Bloom | 455/412.2 |
| 2006/0155591 | A1 | 7/2006 | Altaf et al. | |
| 2006/0184417 | A1 | 8/2006 | Van der Linden et al. | |
| 2006/0230137 | A1 | 10/2006 | Gare et al. | |
| 2006/0270419 | A1 | 11/2006 | Crowley et al. | |
| 2006/0278702 | A1 * | 12/2006 | Sakai | 235/382 |
| 2007/0001835 | A1 * | 1/2007 | Ward et al. | 340/522 |
| 2007/0001841 | A1 * | 1/2007 | Anders et al. | 340/539.13 |
| 2007/0069884 | A1 * | 3/2007 | Waxman | 340/539.1 |
| 2007/0096871 | A1 * | 5/2007 | Mason et al. | 340/5.61 |
| 2007/0100704 | A1 | 5/2007 | Liu et al. | |
| 2007/0136140 | A1 | 6/2007 | Smith | |
| 2007/0162315 | A1 | 7/2007 | Hodges | |
| 2007/0273474 | A1 | 11/2007 | Levine | |
| 2007/0286378 | A1 | 12/2007 | Brown et al. | |
| 2008/0014947 | A1 * | 1/2008 | Carnall | 455/437 |
| 2008/0059254 | A1 | 3/2008 | Vivadelli et al. | |
| 2008/0068162 | A1 * | 3/2008 | Sharma et al. | 340/545.1 |
| 2008/0129444 | A1 * | 6/2008 | Nassimi | 340/5.2 |
| 2008/0153511 | A1 | 6/2008 | Mock | |
| 2008/0162198 | A1 | 7/2008 | Jabbour et al. | |
| 2008/0182590 | A1 | 7/2008 | Ruckart et al. | |
| 2008/0195457 | A1 | 8/2008 | Sherman et al. | |
| 2008/0270238 | A1 | 10/2008 | Zweben et al. | |
| 2008/0287142 | A1 | 11/2008 | Keighran | |
| 2008/0291013 | A1 * | 11/2008 | McCown et al. | 340/539.13 |
| 2009/0005069 | A1 * | 1/2009 | McAlexander | 455/456.1 |
| 2009/0018996 | A1 | 1/2009 | Hunt et al. | |
| 2009/0022131 | A1 | 1/2009 | Rusanen et al. | |
| 2009/0058638 | A1 * | 3/2009 | Kanagala et al. | 340/539.13 |
| 2009/0106077 | A1 | 4/2009 | Bhogal et al. | |
| 2009/0119400 | A1 | 5/2009 | Fukazawa | |
| 2009/0148827 | A1 | 6/2009 | Argott | |
| 2009/0163224 | A1 | 6/2009 | Dean et al. | |
| 2009/0186611 | A1 | 7/2009 | Stiles et al. | |
| 2009/0219156 | A1 * | 9/2009 | August et al. | 340/572.1 |
| 2009/0222324 | A1 | 9/2009 | Johnson | |
| 2009/0237203 | A1 * | 9/2009 | Determan et al. | 340/5.52 |
| 2009/0273441 | A1 | 11/2009 | Mukherjee | |
| 2009/0298514 | A1 * | 12/2009 | Ullah | 455/456.5 |
| 2009/0307096 | A1 | 12/2009 | Antonellis | |
| 2010/0015993 | A1 | 1/2010 | Dingler et al. | |
| 2010/0090827 | A1 * | 4/2010 | Gehrke et al. | 340/539.13 |
| 2010/0106748 | A1 | 4/2010 | Schultz et al. | |
| 2010/0109864 | A1 * | 5/2010 | Haartsen et al. | 340/539.13 |
| 2010/0114613 | A1 | 5/2010 | Smith et al. | |
| 2010/0146499 | A1 | 6/2010 | Bush et al. | |
| 2010/0151821 | A1 | 6/2010 | Sweeney et al. | |
| 2010/0161432 | A1 | 6/2010 | Kumanov et al. | |
| 2010/0267399 | A1 | 10/2010 | Sweeney et al. | |
| 2010/0273509 | A1 | 10/2010 | Sweeney et al. | |
| 2010/0277315 | A1 * | 11/2010 | Cohn et al. | 340/540 |
| 2010/0283579 | A1 * | 11/2010 | Kraus et al. | 340/5.7 |
| 2010/0318615 | A1 | 12/2010 | Griffin | |
| 2010/0332268 | A1 | 12/2010 | Ohmori et al. | |
| 2011/0010218 | A1 | 1/2011 | Gupta | |
| 2011/0128145 | A1 * | 6/2011 | Todd et al. | 340/539.11 |
| 2011/0173263 | A1 | 7/2011 | Beers et al. | |

OTHER PUBLICATIONS

U.S. Appl. No. 12/332,537; Non-Final Rejection dated Apr. 27, 2011; 19 pages.

U.S. Appl. No. 12/424,178 Non-Final Rejection dated Jul. 1, 2011; 15 pages.

U.S. Appl. No. 12/424,178; Final Office Action dated Dec. 28, 2011; 20 pages.

U.S. Appl. No. 12/424,178; Notice of Panel Decision from Pre-Appeal Brief Review dated May 3, 2012; 2 pages.

U.S. Appl. No. 12/499,412; Requirement for Restriction/Election dated Apr. 27, 2012; 7 pages.

U.S. Appl. No. 12/428,051; Final Rejection dated Feb. 23, 2012; 19 pages.

U.S. Appl. No. 12/428,051; Non-Final Rejection dated Sep. 23, 2011; 21 pages.

U.S. Appl. No. 12/499,412; Non-Final Rejection dated Sep. 26, 2012; 35 pages.

U.S. Appl. No. 12/428,051; Non-Final Rejection dated Aug. 2, 2012; 36 pages.

"Resource Scheduling in Hoteling Environments," published by www.peoplecube.com via web.archive.org on Jul. 21, 2008, pp. 1-3 of 3.

U.S. Appl. No. 12/332,537; Non-Final Rejection dated Feb. 15, 2013; 46 pages.

U.S. Appl. No. 12/424,178 Non-Final Rejection dated Mar. 18, 2013; 43 pages.

U.S. Appl. No. 12/428,051; Issue Notification dated Apr. 3, 2013; 1 page.

U.S. Appl. No. 12/428,051; Notice of Allowance dated Dec. 28, 2012; 27 pages.

U.S. Appl. No. 12/428,051; Notice of Allowance dated Dec. 3, 2012; 25 pages.

U.S. Appl. No. 12/499,412; Final Rejection dated Apr. 26, 2013; 22 pages.

(56) References Cited

OTHER PUBLICATIONS

U.S. Appl. No. 12/332,537; Final Rejection dated Sep. 13, 2013; 36 pages.
U.S. Appl. No. 12/424,178 Non-Final Rejection dated Sep. 26, 2013; 38 pages.
U.S. Appl. No. 12/499,412; Notice of Allowance dated Oct. 11, 2013; 41 pages.
U.S. Appl. No. 12/332,537; Non-Final Rejection dated Jan. 3, 2014; 39 pages.
U.S. Appl. No. 12/499,412; Issue Notification dated Jan. 29, 2014; 1 page.
U.S. Appl. No. 12/332,537; Final Rejection dated May 8, 2014; 33 pages.
U.S. Appl. No. 12/424,178; Final Rejection dated May 27, 2014; 48 pages.

* cited by examiner

100

Wireless Device Monitoring System 300
135
140
Server 190
180c
180b
Computing devices 120
Network 110
180n
Servers 130
180a
106
108
102
101
109
Wireless Devices 104

FIGURE 6

Data Table
600

602 606 608

| Device Nickname | Access Point ID | Wireless Device ID |
|---|---|---|
| Dad's Blackberry | 00-B0-D0-86-BB-F7 | 00-0C-F1-56-98-AD 628 |
| Mom's Phone | 00-B0-D0-86-BB-F7 | 214-785-4561 630 |
| John's Phone | 00-B0-D0-86-BB-F7 | 214-785-4611 |
| Dad's Laptop | 00-B0-D0-86-BB-F7 | 00-0C-F1-44-F7-5D |
| Aunt Jackie | 00-B0-D0-86-BB-F7 | 214-514-3024 |
| etc.... | | |
| | | |
| | | |
| | | |
| | | |
| | | |

SYSTEM AND METHOD FOR MONITORING A LOCATION

BACKGROUND

Mobile devices, such as, cellular phones and personal digital assistants (PDAs), are often configured with short range wireless transmitters to enable wireless communication over a network. The signals transmitted by the wireless transmitters may be detected by a base station when the device is within the proximity of the base station. A base station is a radio receiver/transmitter that serves as the hub of a local wireless network and may also be the gateway to a wired network.

SUMMARY

According to one embodiment of the invention, a method for monitoring a location is presented. The method includes monitoring one or more entryways of a building to detect when an entryway of the building is being opened and responsive to detecting an entryway of the building being opened, the method monitors for a presence of one or more wireless devices within a range of a residential wireless access point located within the building. In response to detecting the presence a wireless device within the range of the residential wireless access point, the method identifies an identifier associated with the wireless device. The method determines whether the identifier associated with the wireless device is registered with the residential wireless access point and responsive to the identifier associated with the wireless device being unregistered with the residential wireless access point, the method performs a user-specified event.

BRIEF DESCRIPTION OF THE DRAWINGS

For a more complete understanding of the present application, the objects and advantages thereof, reference is now made to the following descriptions taken in conjunction with the accompanying drawings, in which:

FIG. 6 is an embodiment of a data table of registered wireless devices associated with the wireless device monitoring system.

DETAILED DESCRIPTION OF THE DRAWINGS

The disclosed embodiments provide a system and method for monitoring a location. In today's society mobile devices, such as, for example, cellular phones and personal digital assistants (PDAs) are ubiquitous. The disclosed embodiments recognize that criminals often carry cellular devices on them while committing a crime. Further, the disclosed embodiments recognize that for some people (e.g., the elderly) remembering to manually turn on and off an alarm system may be problematic. Accordingly, the disclosed embodiments present a system and method for monitoring a location in view of the above recognitions.

Figure 1:
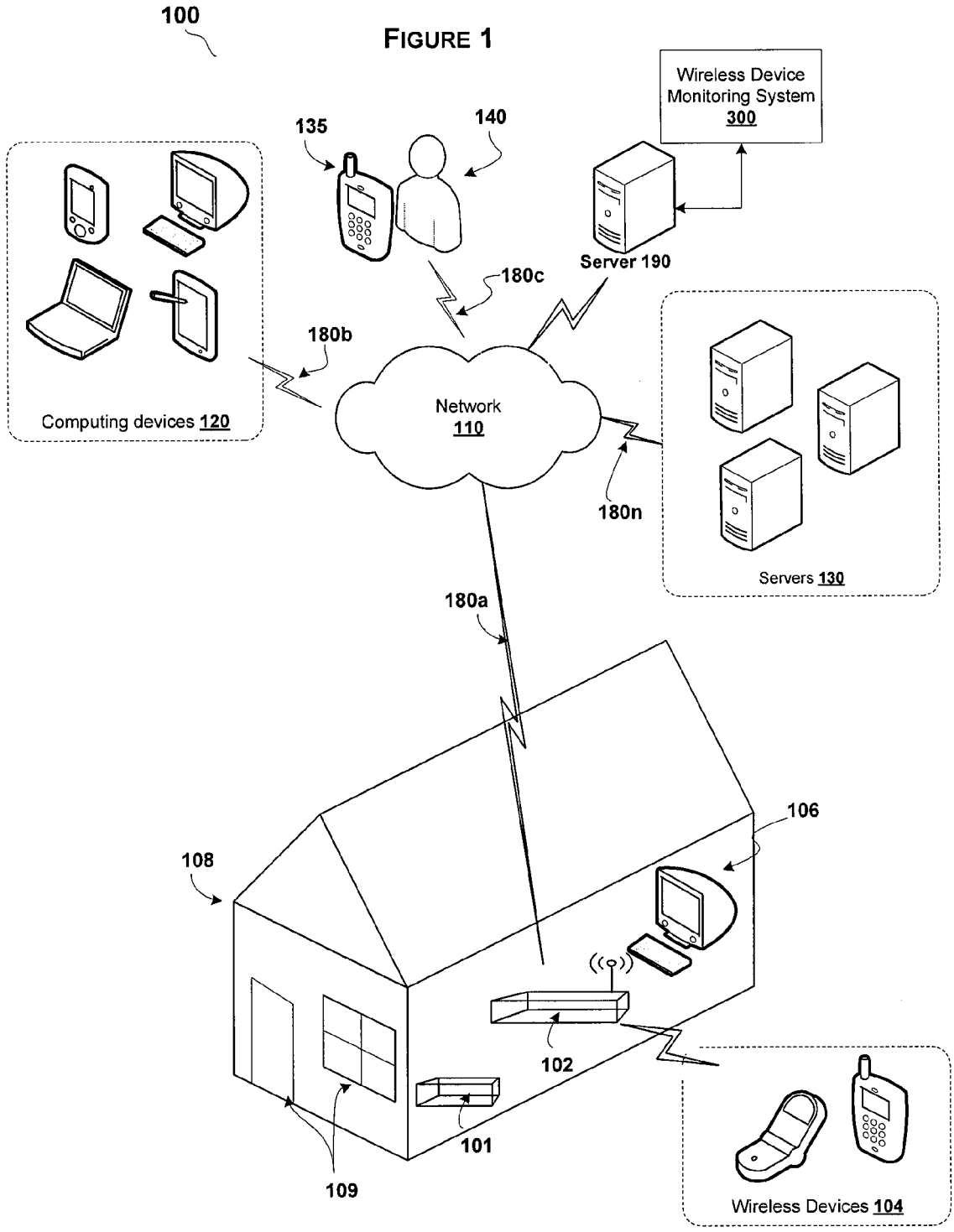
FIG. 1 depicts a environment in which the illustrative embodiments may be implemented.
Figure 2:
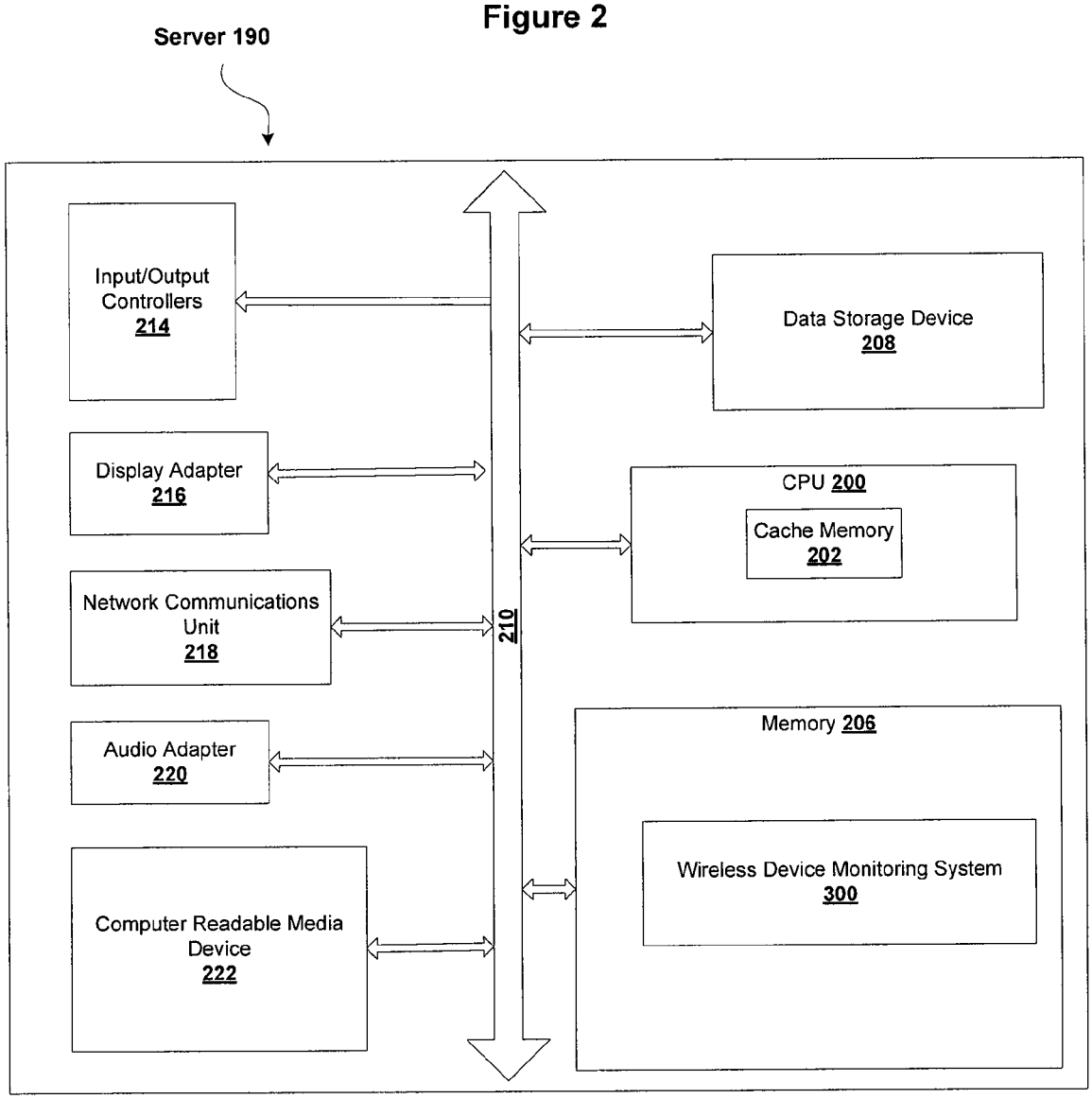
FIG. 2 is an embodiment of a computing device in which the illustrative embodiments may be implemented.

With reference now to the figures and in particular with reference to FIGS. 1-2, exemplary diagrams of data processing environments are provided in which illustrative embodiments may be implemented. It should be appreciated that FIGS. 1-2 are only exemplary and are not intended to assert or imply any limitation with regard to the environments in which different embodiments may be implemented. Many modifications to the depicted environments may be made.

FIG. 1 depicts a network environment 100 in which the illustrative embodiments may be implemented. Network environment 100 includes network 110, which is the medium used to provide communications links between various devices and computers, such as, but not limited to, residential wireless access point 102, wireless devices 104, computing device 106, electronic device 135, computing devices 120, servers 130, and server 190 together within network environment 100. Network 110 may include connections 180*a*-180*n*, such as, but is not limited to, wire, wireless communication links, or fiber optic cables to each of the devices.

Residential wireless access point 102 is a wireless access point located in a residential location, such as, but not limited to, residential location 108. Residential location 108 may be any type of building including, but not limited to, a house, an apartment, a warehouse, and/or a school building. Residential location 108 may include one or more entryways 109, such as, but not limited to, windows, doors, and/or rooftop access.

Residential wireless access point 102 may be used to connect wired and wireless devices, such as, but not limited to, computing device 106 and wireless devices 104 to network 110. Wireless devices 104 may include, but are not limited to, cellular phones, mobile computing device, pagers, two-way radios, smart phones, and/or any other mobile computing device that utilizes a wireless protocol for transmitting and receiving data.

In one embodiment, residential wireless access point 102 also communicates using wired and/or wireless links with an entry detection device 101. Entry detection device 101 may be used to detect an entryway 109 of residential location 108 being opened. As referenced herein, the term "opened" shall include unlatched, unlocked, broken (e.g., a widow), or the occurrence of another event indicative of entry or intrusion. Alternatively, in some embodiments, this feature may be incorporated into residential wireless access point 102. Additionally, residential wireless access point 102 may detect cellular network signals, such as, but not limited to, Global System for Mobile Communications (GSM) and Code Division Multiple Access (CDMA) signals transmitted by a cellular device. In addition, in some embodiments, residential wireless access point 102 may detect other wireless signals, such as, but not limited to, Wi-Fi, and Bluetooth signals and/or other wireless signals utilizing the Wireless Application Protocol (WAP) for providing secure data transmission.

Servers 130 may include one or more servers, such as, but not limited to web servers, database servers, file servers, mail servers, and application servers. In addition, computing devices 120 may be, for example, personal computers, network computers, laptops, personal digital assistants (PDAs), and/or smart phones. In some embodiments, servers 130 provide data and/or services to computing devices 120 and/or other clients connected to network 110. Network environment 100 may include additional servers, clients, and other devices not shown.

In one embodiment, network 110 is the Internet. The Internet is a global system of interconnected computer networks that interchange data using the standardized Internet Protocol Suite (TCP/IP). The Internet includes millions of private and public networks that are linked by copper wires, fiber-optic cables, wireless connections, and other technologies. Of course, network 110 may also be implemented as a number of different types of networks, such as, but not limited to, an intranet, a local area network (LAN), or a wide area network (WAN).

As previously stated, the disclosed embodiments provide a system and method for monitoring a location. The disclosed embodiments utilize a residential wireless access point, such as, but not limited to, residential wireless access point 102 for detecting a signal transmitted by wireless devices 104. Residential wireless access point 102 is associated with a user, such as, but not limited to, user 140. User 140 configures a wireless device monitoring system 300 to perform specified events in response to the detection wireless devices 104. For example, in some embodiments, user 140 utilizing computing device 106 may configure wireless device monitoring system 300 executing on server 190 over network 110. For instance, the disclosed embodiments may be a service provided by a service provider, such as, but not limited to, a telecom service provider. Alternatively, in some embodiments, wireless device monitoring system 300 may be locally executed at a residential location. For example, wireless device monitoring system 300 may be locally executed on computing device 106 at residential location 108.

In some embodiments, wireless device monitoring system 300 may communicate with other data processing systems, such as, but not limited to, servers 130 to perform a user-specified event in response to residential wireless access point 102 detecting an unregistered wireless device. As an example, in one embodiment, user 140 may configure wireless device monitoring system 300 to transnut a message, such as, but not limited to, a text message to an electronic device 135 in response to residential wireless access point 102 detecting an unregistered wireless device, such as, but not limited to, wireless devices 104. Electronic device 135 may be any type of electronic device including, but not limited to, a cellular/smart phone, a PDA, and/or a computing device associated with user 140.

With reference now to FIG. 2, an embodiment of server 190 in which the illustrative embodiments may be implemented is presented. In this embodiment, computing device 120 includes communications bus 210, which provides communications between central processing unit (CPU) 200, memory 206, data storage device 208, input/output (I/O) controllers 214, display adapter 216, network communications unit 218, audio adapter 220, and computer readable media device 222.

CPU 200 executes instructions for software that may be loaded into memory 206. CPU 200 may be a set of one or more processors or may be a multi-processor core, depending on the particular implementation. Further, CPU 200 may include one or more levels of cache memory, such as, but not limited to, cache memory 202. Cache memory 202 is used by CPU 200 to store copies of the data from the most frequently used main memory locations to reduce the average time to access memory.

Memory 206 is used to retain digital data used for processing. In some embodiments, memory 206 may be a random access memory (RAM). RAM memory allows the stored data to be accessed in any order as opposed to storage mechanisms, such as tapes and magnetic discs. In addition, memory 206 may include any other suitable volatile or non-volatile storage device.

CPU 200 loads computer executable instructions, such as, but not limited to, wireless device monitoring system 300 into memory 206 for execution. As will be further described, in some embodiments, wireless device monitoring system 300 may include one or more modules containing computer executable instructions for managing events associated with the detection of a wireless device. In addition, in some embodiments, CPU 200 in executing computer executable instructions associated with wireless device monitoring system 300 may execute instructions for sending and/or retrieving data from one or more computing devices. Further, in some embodiments, CPU 200 may execute in parallel with one or more processors on the same and/or different computing device in connection with executing the instructions associated with wireless device monitoring system 300.

Data storage device 208 may take various forms depending on the particular implementation. For example, data storage device 208 may be a hard drive, flash memory, rewritable optical disk, rewritable magnetic tape, or some combination thereof The media used by data storage device 208 also may be removable, such as, but not limited to, a removable hard drive.

Input/output unit 214 may include one or more of the same and/or different types of data ports used for connecting external devices to computing device 120. Input/output unit 214 may include a serial port, a parallel port, an accelerated graphics port, and most commonly a universal serial bus (USB) port. For example, input/output unit 214 may be used to connect computer peripherals, such as mice, keyboards, PDAs, gamepads and joysticks, scanners, digital cameras, printers, personal media players, and flash drives.

Display adapter 216 is used to generate and output images to a display. Display adapter 216 may be a dedicated expansion card that is plugged into a slot on the motherboard of computing device 120 or may a graphics controller integrated into the motherboard chipset. In addition, display adapter 216 may include dedicated memory and one or more processing units.

Network communications unit 218 provides for communications with other data processing systems or devices. In these examples, network communications unit 218 is a network interface card. Modems, cable modem, Ethernet cards, and wireless interface cards are just a few of the currently available types of network interface adapters. Network communications unit 218 may provide communications through the use of physical and/or wireless communications links.

Audio adapter 220 facilitates the input and output of audio signals to and from computing device 120. For example, audio adapter 220 may provide the audio component for multimedia applications, such as music composition, editing video or audio, presentation/education, and/or entertainment, such as video games. In some embodiments, audio adapter 220 may be an expansion card added to computing device 120 to provide for audio capability.

Computer readable media device 222 provides a mechanism for reading and writing to tangible forms of computer media, such as, but not limited to, a floppy disc, a compact disc (CD), a digital versatile disc (DVD), and memory cards. For example, CPU 200 may use computer readable media device 222 to read instructions stored on a computer media for executing the computer executable instructions of wireless device monitoring system 300.

The different components illustrated for server 190 are not meant to provide architectural limitations to the manner in which different embodiments may be implemented. For example, the different illustrative embodiments may be implemented in a data processing system including components in addition to or in place of those illustrated for server 190.

Figure 3:
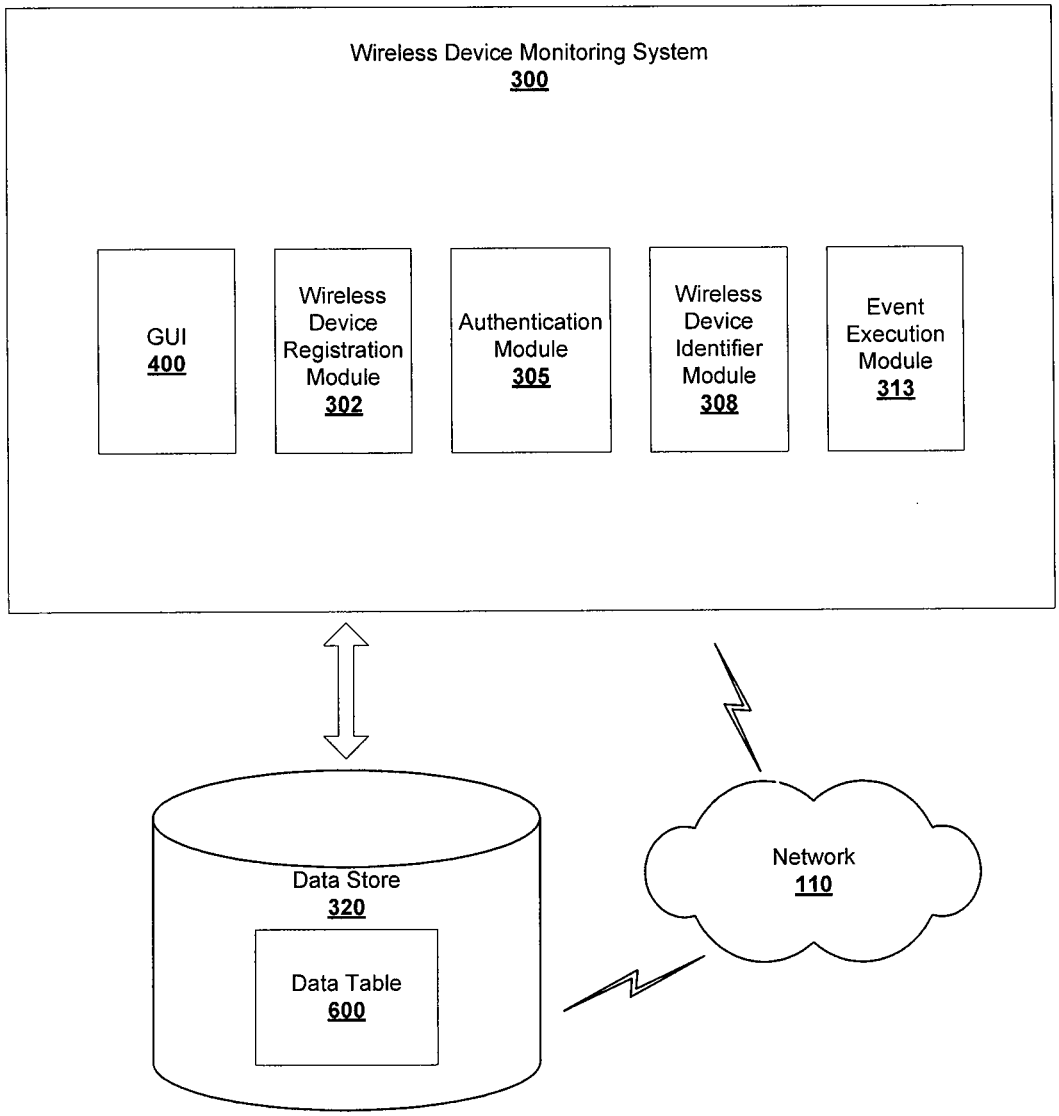
FIG. 3 is an embodiment of a wireless device monitoring system for managing events associated with the detection of an unregistered wireless device.

FIG. 3 is an embodiment of wireless device monitoring system 300 for monitoring a location. In one embodiment, wireless device monitoring system 300 includes, among other modules, a graphical user interface (GUI) 400, wireless device registration module 302, authentication module 305, wireless device identifier module 308, event trigger analyzer module 310, event execution module 313.

Figure 4:
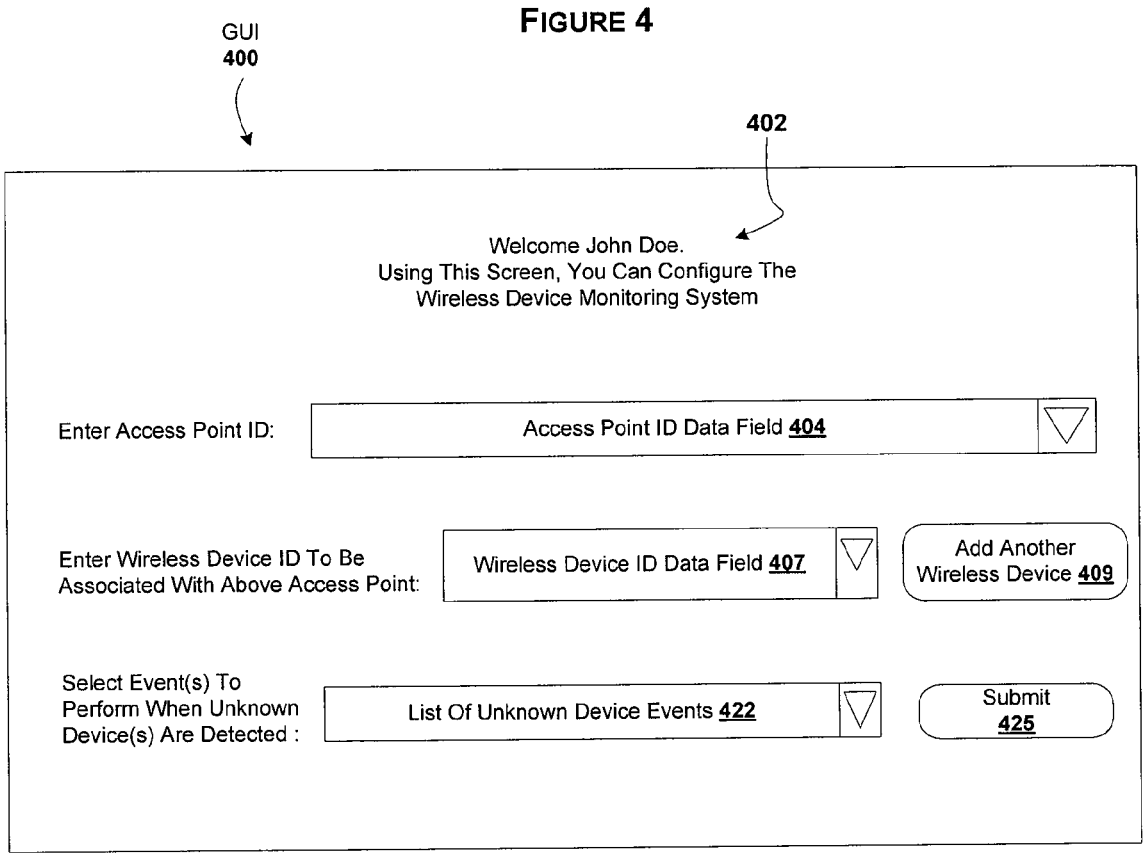
FIG. 4 is an embodiment of a graphical user interface for registering wireless devices and for managing events associated with the wireless device monitoring system.

Graphical user interface 400, as will be further described in FIG. 4, may be used to configure wireless device monitoring system 300. For instance, in some embodiments, user 140 may log into wireless device monitoring system 300 over network 110. Wireless device monitoring system 300 presents the user with graphical user interface 400. In some embodiments, graphical user interface 400 may be implemented as part of a web page. Alternatively, in some embodiments, graphical user interface 400 may be implemented as a separate software application.

Wireless device registration module 302 may be used for registering a residential wireless access point associated with user 140, such as, but not limited to, residential wireless access point 102. In addition, in some embodiments, wireless device registration module 302 may be used for configuring events associated with residential wireless access point 102 detecting an unknown wireless device. Further, in some embodiments, wireless device registration module 302 may be used to configure the signal detection range of residential wireless access point 102 by adjusting the signal strength of a transceiver associated with the residential wireless access point based on the size and/or shape of the building. For instance, a user residing in an apartment complex may configure residential wireless access point 102 to detect wireless signals only within a small range.

In addition, in some embodiments, authentication module 305 provides secure access to wireless device monitoring system 300. For example, in some embodiments, authentication module 305 may be used to authenticate a username and/or password of user 140 prior to allowing user 140 to configure and/or access wireless device monitoring system 300. Thus, an unauthorized user may not alter the configurations settings of a residential wireless access point associated with another user.

Wireless device identifier module 308 identifies the identity of a residential wireless access point and wireless devices that are detected the identified residential wireless access point. In some embodiments, wireless device identifier module 308 extracts an identifier, such as, but not limited to, a Media Access Control (MAC) address to identify a particular residential wireless access point, such as, but not limited to, residential wireless access point 102. In addition, wireless device identifier module 308 may extract an identifier, such as, but not limited to, a MAC address, a Mobile Identification Number (MIN), and/or an International Mobile Equipment Identity (IMEI) associated with a wireless device detected by residential wireless access point 102 to identify the particular wireless device. In some embodiments, wireless device identifier module 308 may communicate with an external database and/or computing device to correlate the retrieved identifier of a wireless device with the identity of a person associated with the wireless device. For example, in some embodiments, as will be further described, if a wireless device detected by a particular residential wireless access point is not registered with the residential wireless access point (i.e., an unknown wireless device), wireless device identifier module 308 may retrieve data from a caller identification platform/service, a 411 database, an internet directory, a service provider subscriber account database, or any other available source for identifying a person associated with the wireless device.

Further, in some embodiments, wireless device identifier module 308 may store an identifier associated with the wireless device and may also store time data corresponding to a period of time that the wireless device is detected by a residential wireless access point. Wireless device monitoring system 300 may provide the identifier and the time data to an authorized recipient, such as, but not limited to, a user associated with the residential wireless access point and/or to a law enforcement agency. For example, although, a video camera may provide video of a crime, the video does not provide any identifying information of a perpetrator unless someone recognizes the perpetrator. With the disclosed embodiments, if the perpetrator is carrying a cellular device, information gathered by wireless device monitoring system 300 may be used by law enforcement to identify the perpetrator.

Event execution module 313 performs a user-specified event in response to a determination that an identifier associated with a wireless device is unregistered with the residential wireless access point. Event execution module 313 may communicate with one or more computing devices in performing the specified event. For example, in some embodiments, event execution module 313 may communicate with a home security system to trigger an audible alarm at the residential location. In some embodiments, the audible alarm function may be incorporated into a residential wireless access point. In another embodiment, event execution module 313 may communicate with a mail server for transmitting an email message to a specified user in response to detecting an unregistered wireless device. Further, in some embodiments, event execution module 313 may place a call to the wireless device. For instance, an intruder may flee the premises because he is startled by the unexpected call and/or afraid that others have been alerted of his presence. Additionally, in some embodiments, an audio message and/or a text message may be transmitted to the wireless device notifying an intruder that his presence has been detected and/or recorded.

Further, in some embodiments, the configuration data associated with wireless device monitoring system 300, such as, but not limited to, the identifiers of residential wireless access point 102 and registered wireless devices 104 may be stored in one or more local and/or remote data store, such as, but not limited to, data store 320. In some embodiments, data store 320 may be accessed by wireless device monitoring system 300 via network 110. In addition, in some embodiments, data store 320 may include one or more data tables, such as, but not limited to, data table 600.

FIG. 4 is an embodiment of graphical user interface 400 for managing events associated with a wireless detection program. In some embodiments, graphical user interface 400 may be presented as part of a web page and/or may appear as an individual window. Graphical user interface 400 is provided merely as an illustrative example and does not imply a particular design, implementation, and/or limitation of the disclosed embodiments. For example, in some embodiments, features/functions may be added, deleted, modified, and/or combined.

In the depicted embodiment, graphical user interface 400 includes a welcome message 402 identifying a user logged into wireless device monitoring system 300. In addition, graphical user interface 400 may include one or more data fields, such as, but not limited to, access point id data field 404, wireless device id data field 407, and list of unknown device events 422.

Access point id data field 404 enables a user to manually enter in an identifier, such as, but not limited to, a MAC address associated with a residential wireless access point. In some embodiments, access point id data field 404 may include a pull down menu for enabling a user to select a residential wireless access point that was previously associated with the user.

After selecting and/or entering a residential wireless access point associated with the user, wireless device id data field 407 enables a user to register an identifier associated with a wireless device. The entered wireless devices are registered with the selected/entered residential wireless access point indicated in access point id data field 404. In some embodiments, a user may register additional wireless devices with the selected/entered residential wireless access point by selecting option add another wireless device 409. In addition, in some embodiments, wireless device id data field 407 may include a pull down menu to enable a user to select one or more previously registered wireless devices.

List of unknown device events 422 displays a list of selectable events to perform in response to the residential wireless access point specified in access point id data field 404 detecting an unregistered wireless device. For example, in some embodiments, if an unknown/unregistered wireless device is detected within the signal range of residential wireless access point 102, a text message may be sent to a specified device associated with a user, such as, but not limited to, electronic device 135 associated with user 140. Submit button 425 enables a user to submit the user-selected events in list of unknown device events 422 to wireless device monitoring system 300.

Figure 5:
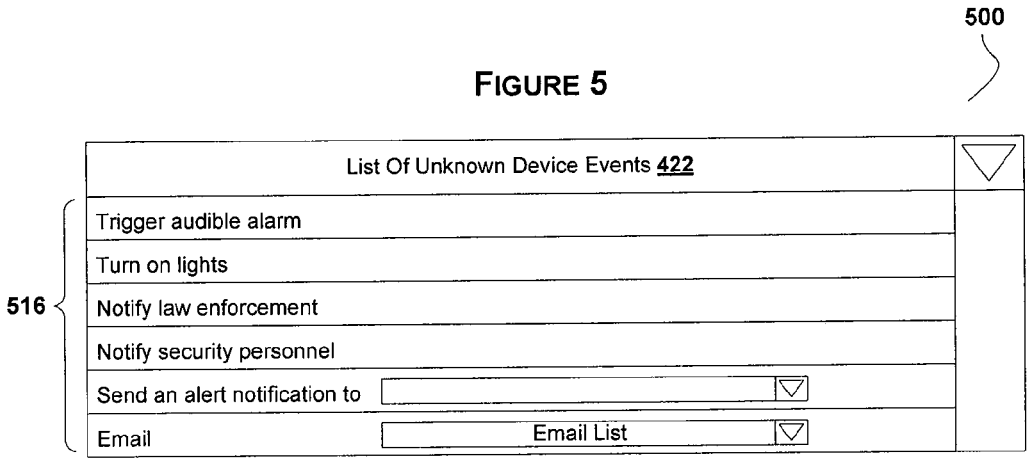
FIG. 5 is an embodiment of a graphical user interface for selecting events associated with the wireless device monitoring system detecting an unregistered wireless device.

FIG. 5 is an embodiment of a graphical user interface 500 for selecting events associated with wireless device monitoring system 300 detecting an unregistered wireless device. Graphical user interface 500 includes an embodiment of list of unknown device events 422. Graphical user interface 500 is provided merely as an illustrative example and does not imply a particular design, implementation, and/or limitation of the disclosed embodiments.

In the depicted example, list of unknown device events 422 includes one or more events 516 to perform in response to residential wireless access point 102 detecting an identifier of an unknown wireless device. For instance, in some embodiments, wireless device monitoring system 300 may transmit an email to a user-specified email address and/or sound an alarm system in response to detecting an unknown wireless device. List of unknown device events 422 may include other features not depicted in FIG. 5.

FIG. 6 is an embodiment of a data table 600 of registered wireless devices associated with wireless device monitoring system 300 and residential wireless access point 102. Data table 600 may be stored in a data store, such as, but not limited to, data store 320 depicted in FIG. 3. Data table 600 illustrates a pictorial representation of a data table and does not imply a particular implementation, design, and/or architecture. In the depicted embodiment, data table 600 includes a device nickname column 602, residential wireless access point identifier column 606, and wireless device identifier column 608.

Device nickname column 602 contains the nicknames of wireless devices associated with a user. In some embodiments, a device nickname may be specified at the time of associating a wireless device with a particular residential wireless access point. For example, in some embodiments, a device nickname data field may be added to graphical user interface 400 to associate a nickname with particular wireless device. The nicknames enable a user to easily identify a registered wireless device.

Residential wireless access point identifier column 606 contains an identifier associated with a residential wireless access point, such as, but not limited to, residential wireless access point 102. In some embodiments, a user may be associated with one or more residential wireless access point. For example, in some embodiments, a user may have multiple residential wireless access points in a residential location to detect wireless devices in different areas of the residential location.

Wireless device identifier column 608 contains the identifiers of wireless devices registered with the corresponding identifiers in residential wireless access point identifier column 606. In some embodiments, the identifier of a wireless device may be a MAC address 628 of a network device associated with the wireless device. In addition, in some embodiments, the identifier of a wireless device may be a Mobile Identification Number 630 (i.e., a telephone number). Further, in some embodiments, the identifier of a wireless device may also be an International Mobile Equipment Identity (IMEI) number associated with the wireless device. In some embodiments, the wireless device identifier is included in a signal broadcasted by the wireless device and is used by wireless device monitoring system 300 to identify a particular wireless device.

Figure 7:
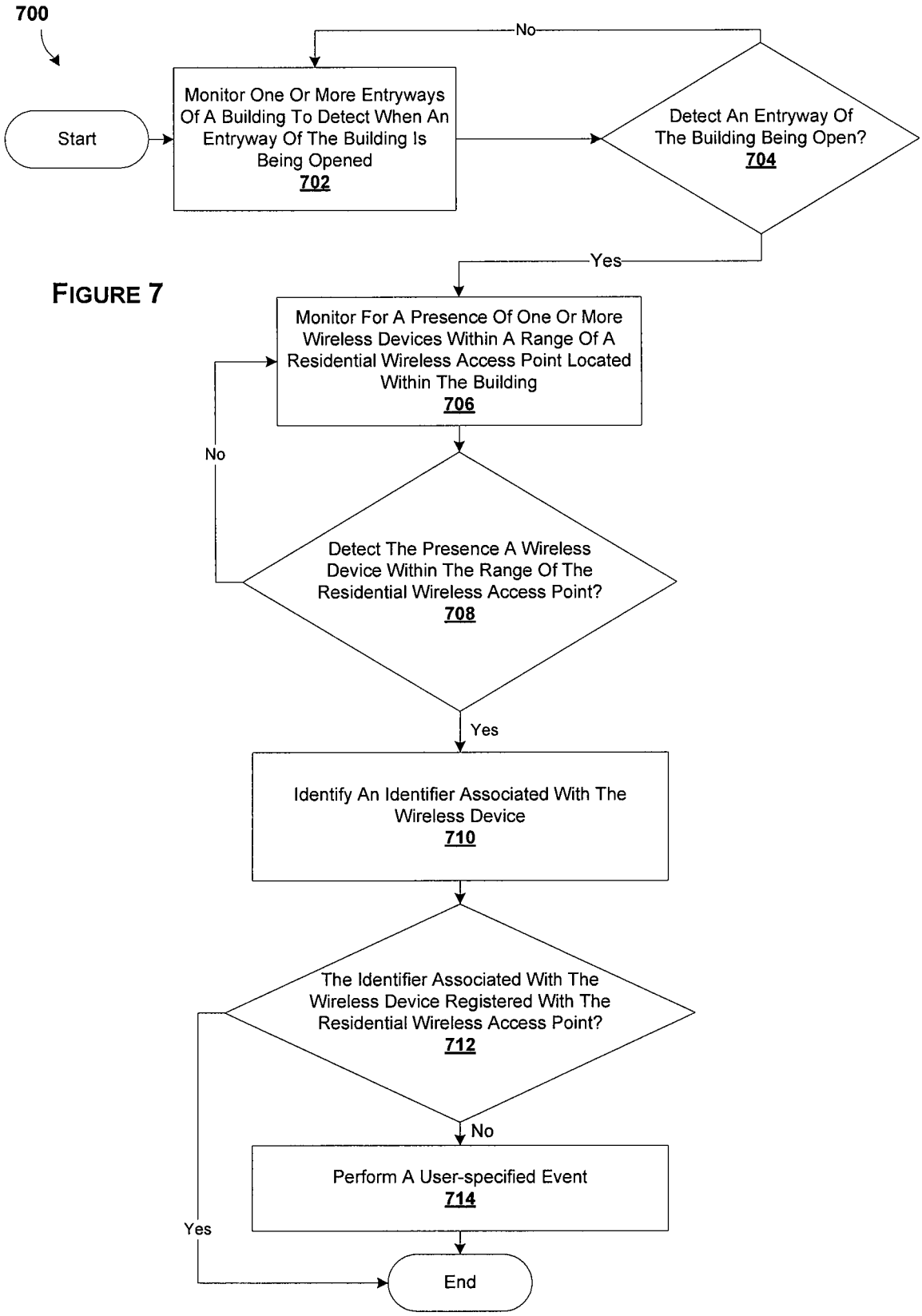
FIG. 7 is an embodiment of a process for monitoring a location.

With reference now to FIG. 7, an embodiment of a process 700 for monitoring a location is presented. Process 700 begins by monitoring one or more entryways of a building to detect when an entryway of the building is being opened at step 702. At step 704, the process determines whether an entryway of the building is being opened. In response to determining that an entryway of the building is being opened, the process, at step 706, monitors for a presence of one or more wireless devices within a range of a residential wireless access point located within the building. At step 708, the process determines whether the residential wireless access point detects the presence of a wireless device (i.e., detecting a signal transmitted by the wireless device). Upon detecting the presence of a wireless device within the range of the residential wireless access point, the process identifies an identifier associated with the wireless device at step 710. The process determines whether the identifier associated with the wireless device is registered with the residential wireless access point at step 712. If the identifier of the wireless device is registered with the residential wireless access point, process 700 terminates. However, if the identifier of the wireless device is not registered with the residential wireless access point, the process performs a user-specified event at step 714, with process 700 terminating thereafter.

Accordingly, the disclosed embodiments provide a system and method for monitoring a location. For example, the disclosed embodiments may be utilized to provide an added level of security for an elderly person who has trouble setting and/or remembering to set a house alarm system. In one embodiment, if an unregistered wireless device is detected within residential location 108, wireless device monitoring system 300 notifies law enforcement of an unlawful entry. In addition, in some embodiments, wireless device monitoring system 300 identifies a user associated with the unregistered wireless device by retrieving data from a service provider subscriber account database. In one embodiment, wireless device monitoring system 300 may also perform a criminal background check on the identified user of an unregistered wireless device. For instance, in one embodiment, wireless device monitoring system 300 passes identifying information about the user to a criminal background check service provider.

In addition, the disclosed embodiments may be used to monitor visitors, such as, but not limited to, alerting a user of when his teenager has friends over or alerting a user of when maintenance personnel and/or cleaning service personnel enters the home. Further, in some embodiments, wireless device monitoring system 300 may provide additional information about the unregistered wireless devices, such as, but not limited to, how long the device was detected and where within residential location 108 was the device detected. For instance, in some embodiments, wireless device monitoring system 300 may be able to determine that the maintenance man was in the master bedroom for 30 minutes, when he should have been in the kitchen fixing the sink.

Further, in some embodiments, the disclosed embodiments may be integrated with other security components, such as, but not limited to, an alarm system and/or a video monitoring system. For instance, in one embodiment, an alarm system may be used to monitor the opening of an entryway and wireless device monitoring system 300 may be used to identify unregistered wireless devices. In response to wireless device monitoring system 300 identifying an unregistered wireless device, wireless device monitoring system 300 may turn on the video monitoring system to capture video images of the user of the unregistered wireless device.

As will be appreciated by one skilled in the art, the disclosed embodiments may be embodied as a system, method, or computer program product. Accordingly, the disclosed embodiments may be implemented entirely with hardware or as a software embodiment (including firmware, resident software, micro-code, etc.) or an embodiment combining software and hardware aspects that may all generally be referred to herein as a "circuit," "module" or "system." Furthermore, the disclosed embodiments may take the form of a computer program product embodied in any tangible medium of expression having computer-usable program code embodied in the medium.

Computer program code for carrying out operations of the present invention may be written in any combination of one or more programming languages, including an object oriented programming language, such as Java, Smalltalk, C++, or the like and conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The disclosed embodiments described above with reference to flowchart illustrations and/or block diagrams. Each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

In addition, the flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which may include one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed:

1. A method for monitoring a location comprising:

providing an entry detection device;

monitoring one or more entryways of a building with the entry detection device to detect when an entryway of the building is being opened;

providing a residential wireless access point within the building in communication with and physically located away from the entry detection device;

responsive to detecting an entryway of the building being opened with the entry detection device, monitoring for a presence of one or more wireless devices with the residential wireless access point;

providing a remote wireless device monitoring system in communication with the residential wireless access point over a network;

responsive to detecting the presence of a wireless device within the range of the residential wireless access point, determining an identifier comprising a telephone number associated with the wireless device with the remote wireless device monitoring system;

determining with the remote wireless device monitoring system whether the identifier associated with the wireless device is registered with the residential wireless access point; and responsive to the identifier associated with the wireless device being unregistered with the residential wireless access point, performing a user-specified event with the remote wireless device monitoring system comprising placing a telephone call to the wireless device.

2. The method of claim 1, wherein performing the user-specified event further comprises triggering an audible alarm at the building.

3. The method of claim 1, wherein performing the user-specified event further comprises sending an alert notification to a user associated with the residential wireless access point.

4. The method of claim 1, wherein performing the user-specified event further comprises sending an alert notification to a specified user.

5. The method of claim 1, wherein performing the user-specified event further comprises notifying law enforcement of an unlawful entry.

6. The method of claim 1, further comprising:

storing the identifier associated with the wireless device;

storing time data corresponding to a period of time that the wireless device is detected by the residential wireless access point; and providing the identifier and time data to an authorized recipient.

7. The method of claim 1, further comprising identifying a user associated with the wireless device by retrieving data from a service provider subscriber account database.

8. The method of claim 7, further comprising performing a criminal background check on the user.

9. The method of claim 1, further comprising adjusting a signal strength of a transceiver associated with the residential wireless access point based on the size of the building.

10. An apparatus comprising:

a data bus system;

memory coupled to the data bus system, the memory includes computer usable program code;

a processing unit coupled to the data bus system, wherein the processing unit executes the computer usable program code to:

monitor one or more entryways of a building with an entry detection device to detect when an entryway of the building is being opened;

monitor for a presence of one or more wireless devices within a range of a residential wireless access point located within the building in response to detecting an entryway of the building being opened, wherein the residential wireless access point is in communication with and physically located away from the entry detection device;

determine an identifier comprising a telephone number associated with a wireless device in response to detecting the presence of the wireless device within the range of the residential wireless access point, wherein the determination of the identifier is made with a remote wireless device monitoring system in communication with the residential wireless access point over a network;

determine with the remote wireless device monitoring system whether the identifier associated with the wireless device is registered with the residential wireless access point; and perform a user-specified event with the remote wireless device monitoring system comprising placing a telephone call to the wireless device in response to the identifier associated with the wireless device being unregistered with the residential wireless access point.

11. The apparatus of claim 10, wherein the processing unit executes the computer usable program code to trigger an audible alarm at the building.

12. The apparatus of claim 10, wherein the processing unit executes the computer usable program code to send an alert notification to a user associated with the residential wireless access point.

13. The apparatus of claim 10, wherein the processing unit executes the computer usable program code to send an alert notification to a specified user.

14. The apparatus of claim 10, wherein the processing unit executes the computer usable program code to notify law enforcement of an unlawful entry.

15. The apparatus of claim 10, wherein the processing unit further executes the computer usable program code to:

store the identifier associated with the wireless device;

store time data corresponding to a period of time that the wireless device is detected by the residential wireless access point; and provide the identifier and time data to an authorized recipient.

16. The apparatus of claim 10, wherein the processing unit further executes the computer usable program code to identify a user associated with the wireless device.

17. The apparatus of claim 16, wherein the processing unit executes the computer usable program code to perform a criminal background check on the user.

18. The apparatus of claim , wherein the processing unit executes the computer usable program code to adjust a signal strength of a transceiver associated with the residential wireless access point based on the size of the building.

* * * * *